United States Patent [19]

Fukui

[11] Patent Number: 4,935,776

[45] Date of Patent: Jun. 19, 1990

[54] IMAGE FORMING APPARATUS

[75] Inventor: Kazuyuki Fukui, Osaka, Japan

[73] Assignee: Minolta Camera Kabushiki Kaisha, Osaka, Japan

[21] Appl. No.: 261,416

[22] Filed: Oct. 24, 1988

[30] Foreign Application Priority Data

Oct. 23, 1987 [JP] Japan ..... 62-268885

[51] Int. Cl.[5] ..... G03G 15/16

[52] U.S. Cl. ..... 355/206; 355/274

[58] Field of Search ..... 355/206–209, 355/271–276, 326–327

[56] References Cited

U.S. PATENT DOCUMENTS 4,110,031 8/1978 Ebi et al. ..... 355/274

FOREIGN PATENT DOCUMENTS 62-90673 4/1987 Japan .

*Primary Examiner*—Joan H. Pendegrass

*Attorney, Agent, or Firm*—Burns, Doane, Swecker & Mathis

[57] ABSTRACT

A transfer medium supporting member which supports a transfer medium to which a toner image formed on a photoconductive member of an image forming apparatus is repeatedly transferred for required number of times, and a potential sensor for measuring the potential of a dielectric screen onto which the transfer medium is electrostatically adsorbed by electrification are provided in combination with each other. The potential of the dielectric screen electrified only by output of an adsorption charger is measured by the potential sensor to judge the electrification capacity of the dielectric screen, and a visual or sound warning is given when the electrification capacity is in a predetermined state. And separately from or in combination with giving the warning, the operation of the apparatus is stopped. Further, separately from them, both or one of outputs of the adsorption charger and a transfer charger for electrostatically transferring a toner image formed on the photoconductive member to the transfer medium are controlled.

23 Claims, 6 Drawing Sheets

IMAGE FORMING APPARATUS

BACKGROUND OF THE INVENTION

1. Technical Field of the Invention

The present invention relates to an image forming apparatus used for multicolor image forming, and particularly to an image forming apparatus in which a transfer medium is electrostatically adsorbed onto a dielectric screen of a transfer medium supporting member for repeated image transfer operations so that toner images successively formed on a photoconductive member can be transferred to the same transfer medium one over another.

2. Brief Description of the Prior Art

Such a kind of conventionally known apparatus is disclosed in a Japanese Unexamined Publication No. 90673/1987. In this apparatus, by electrifying a dielectric screen of a transfer medium supporting member by corona discharge of an adsorption charger, a transfer medium is electrostaticly adsorbed onto the dielectric screen through the electrostatic adsorptive power of the dielectric screen to be supported thereon in a wound state, and is subjected to an image transfer operation. After the transfer operation is completed, the dielectric screen is de-electrified by corona discharge so as to separate the transfer medium therefrom, and thereby the transfer medium carrying a transferred image thereon can be surely delivered to the next step of operation. As the abovementioned dielectric screen, a mesh screen such as a polyester or nylon screen, or a film screen such as a polyester film is used.

However, if the dielectric screen is used for a long time and repeatedlys ubjected to the electrification and de-electrification by corona discharge, toner, papar powder, charged products and the like are attached to the surface of the dielectric screen and the dielectric screen is unevenly deformed thereby disadvantageously lowering the electrification capacity of the dielectric screen. As a result, the electrostatic adsorption of a transfer medium onto the dielectric screen and the release of the same from the adsorbed state are performed only insufficiently, and jamming of the transfer medium, unsatisfactory image transfer or ill separation of the transfer medium are caused.

SUMMARY OF THE INVENTION

A main object of the present invention is to provide an image forming apparatus capable of preventing jamming of a transfer medium, unsatisfactory image transfer and ill separation of a transfer medium caused by the lowering of the electrification capacity by urging an exchange of the dielectric screen at a proper time with a warning given according to its self-detecting function when the electrification capacity of a dielectric screen is lowered to a predetermined level.

Another object of the present invention is to provide an image forming apparatus capable of eliminating a high possibility of causing jamming of a transfer medium, unsatisfactory image transfer and ill separation of a transfer medium in an image forming operation by stopping the apparatus according to its self-detecting function when the electrification capacity of a dielectric screen is lowered to a predetermined level so that the troubles can be prevented.

Further object of the present invention is to provide an image forming apparatus capable of decreasing the ocurrence of jamming of a transfer medium, unsatisfactory image transfer and ill separation of a transfer medium by properly controlling output of both or one of an adsorption changer and a transfer charger in acordance with the extent of lowering of the electrification capacity of the dielectric screen.

Further objects and features of the present invention will beocme apparent from the following description taken in conjunction with the preferred embodiments thereof with reference to the accompanying drawings.

DETAILED DESCRIPTION OF THE INVENTION

Embodiments of the present invention will now be described with reference to the appended drawings.

Figure 1:
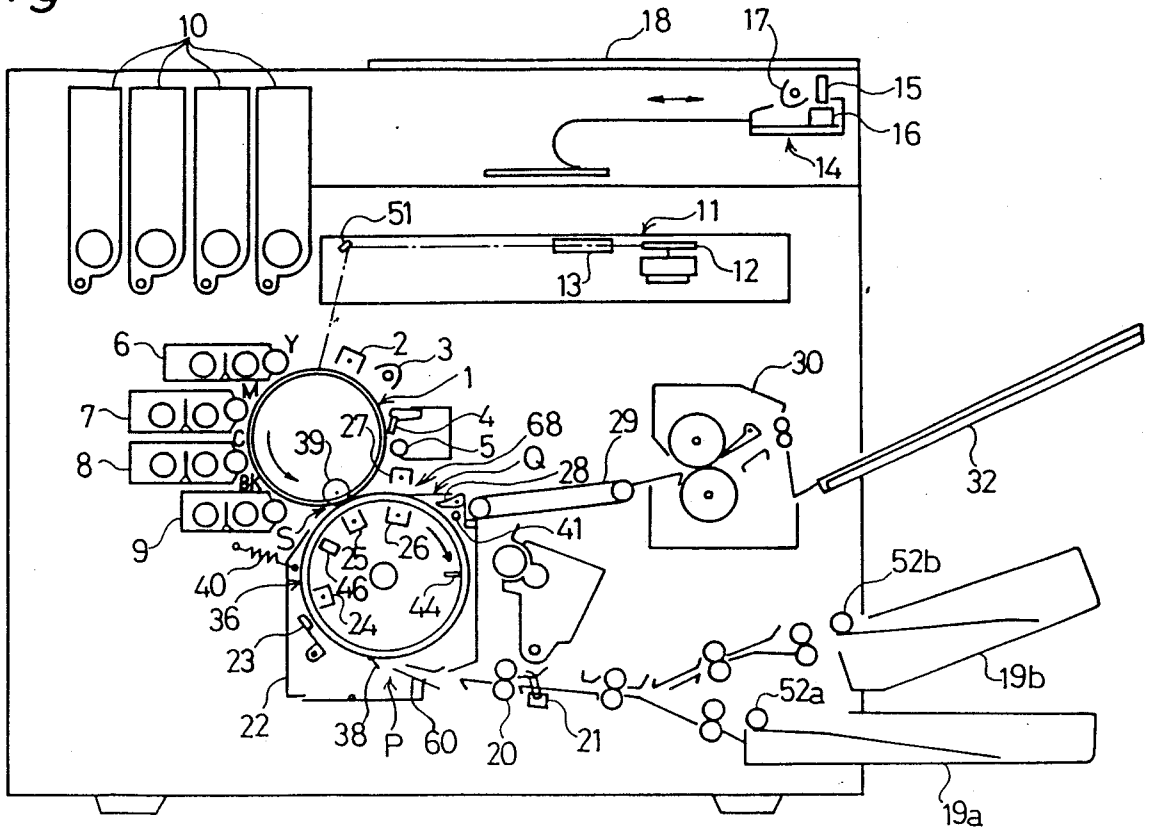
FIG. 1 is a schematic side view of an embodiment in which the present invention is applied to a multi-color copying apparatus.

FIG. 1 shows an embodiment in which the present invention is applied to a multicolor copying apparatus.

An original placed on an original glass plate 18 is illuminated by an exposure lamp 17, exposed onto a CCD line sensor 16 by a lens array 15, and read by the line sensor 16 as color signals of the three primary color R (red), G (green), and B (blue). These color signals R, G, B are converted by an image processing circuit into three signals Y (yellow), M (magenta), and C (cyan) or four signals consisting of the preceding three signals Y, M, C and an additional signal $B_K$ (black), and transmitted as output singals to a laser optical system 11. The copying apparatus of this embodiment is provided with only one image memory, not three, for three colors. Consequently, an image reader unit 14 scans every time each color image is formed, and according to this scanning, signals Y, M, C or Y, M, C, $B_K$ are successively transmitted to a laser optical system 11.

The laser optical system 11 comprises a scanning polygon mirror 12, f$\theta$ lens 13, reflector 51 and the like, and irradiates a photosensitive drum 1 with a laser light for forming image of each color in accordance with the signal Y, M, C or Y, M, C, $B_K$ to execute exposure.

The photosensitive drum 1 is driven to rotate in the direction of the arrow shown in the figure.

On the surface of the photosensitive drum 1 is provided an organic photosensitive member constituted by a charge generating layer and a charge transporting layer laminated on a conductive base plate. As an organic photoconductive member, one which shows a high sensitivity to a laser light of a wavelength about 780 mm is used. Further, in this embodiment, the organic photoconductive member is negatively charged by an electrification charger 2.

Around the photoconductive drum 1, a drum cleaner 4, a toner collecting roller 5, an eraser lamp 3, the electrification charger 2, and four kinds of developer containers 6, 7, 8, 9 are disposed sequentially in the direction of the rotation of the photoconductive drum 1. The first developer container 6 is arranged for supplying yellow toner, the second developer container 7 for magenta toner, the third developer container 8 for cyan toner, and the fourth developer container 9 for black toner, and each toner is negatively charged. Toner is replenished at need according to a signal for replensishment by delivering toner of each color stored in each toner hopper 10 through pipes (not shown) into each developer container 6, 7, 8 and 9.

Figure 2:
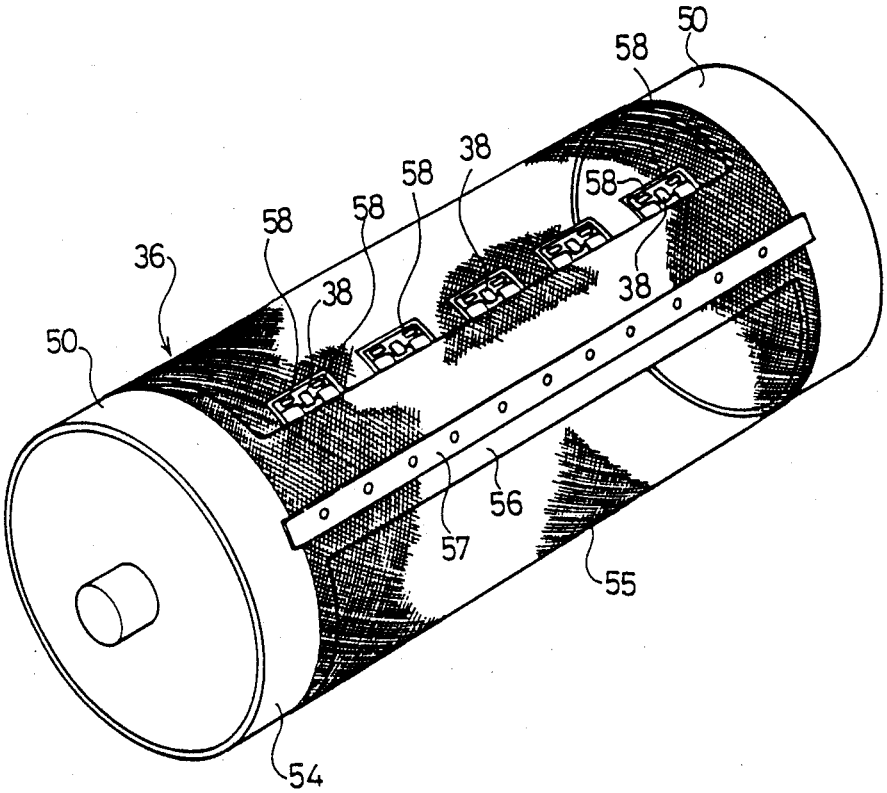
FIG. 2 is a perspective view of a transfer drum of the copying apparatus of FIG. 1.
Figure 3:
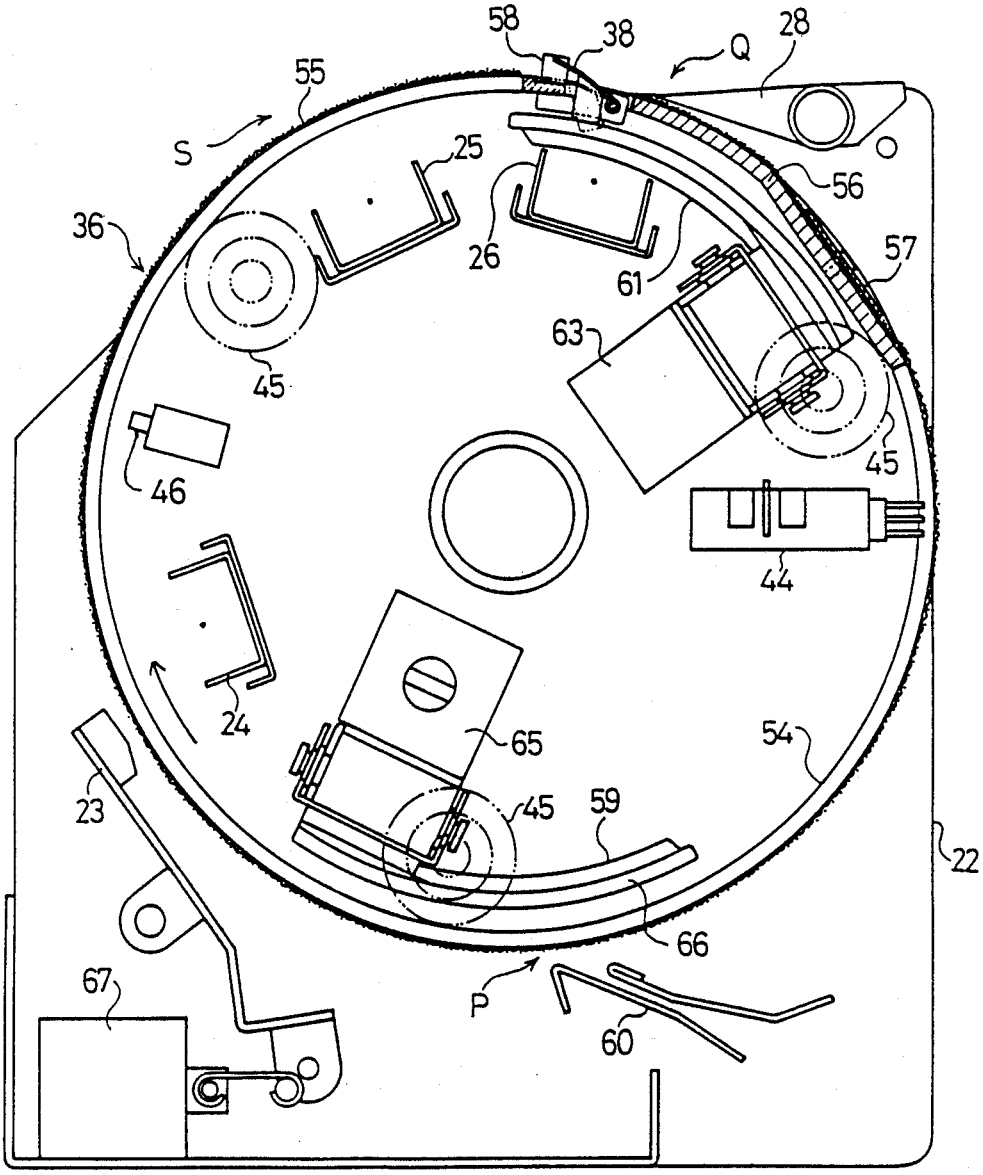
FIG. 3 is a cross-sectional view of the transfer drum and its circumferential arrangements.

Transfer sheets such as ordinary paper sheets, OHP films and the like are accomodated in a stacked state mainly in paper feed cassettes 19*a*, 19*b*, and are fed one by one into the copying machine by paper feed rollers 52*a*, 52*b*. When the leading end of a transfer sheet comes into contact with a pair of resister rollers 20, the sheet is once stopped for adjusting the subsequent timing and at the same time for correcting the position of a skewed sheet. For this purpose, a paper sensor 21 is provided. A transfer drum 36 is provided adjacent to a transfer section of the photoconductive drum 1 and rotatively driven in the direction of the arrow shown in the figure. As shown in FIGS. 2 and 3, the transfer drum 36 mainly comprises a drum frame 54 formed of aluminium, and a dielectric screen 55 supported by and stretched on the drum frame 54 to form a cylindrical shape. The dielectric screen 55 is formed of a polyester net of 50 to 80 mesh, the open area rate of which is about 30 to 70%. A nylon net may be used instead of the polyster net, and further, the dielectric screen 55 may be formed of a film such as a polyster film of about 70 to 120 μm in thickness. The drum frame 54 is constituted by two opposite cylindrical portions 50, 50 and a connecting portion 56 for connecting the two cylindrical portions 50, 50. A banding plate 57 for fixing the opposite ends of the dielectric screen is fastened to the connecting portion 56 and further the connecting portion 56 is provided with a plurality of chucking claws 38, 38 . . . The chucking claws 38, 38 . . . chuck the leading end of each transfer sheet fed in a timed manner by a pair of resister rollers 20. On both sides of each chucking claw 38, a pair of push-up claws 58, 58 are provided for facilitating separation of each transfer sheet. For more precisely, when the transfer sheet is separated from the transfer drum 36, the pair of push-up claws 58, 58 serve to push up the leading end of the transfer sheet interlocking with the opening operation of the chucking claw 38.

The chucking claw 38 is opened when it runs onto a first guide rail 59 disposed inside the transfer drum 36 at a sheet intaking section P shown in FIG. 3. At this time, the push-up claws 58, 58 are kept in the closed state. The leading edge of a transfer sheet fed by the pair of resister rollers 20 and guided to the sheet intaking section P by a transfer sheet guide 60 is transported inbetween the chucking claw 38 in the open state and the push-up claws 58, 58 in the closed state. When the chucking claw 38 has passed through the first guide rail 59 as the transfer drum 36 rotates, the chucking claw 38 is closed to chuck the leading end of the transfer sheet.

Figure 4:
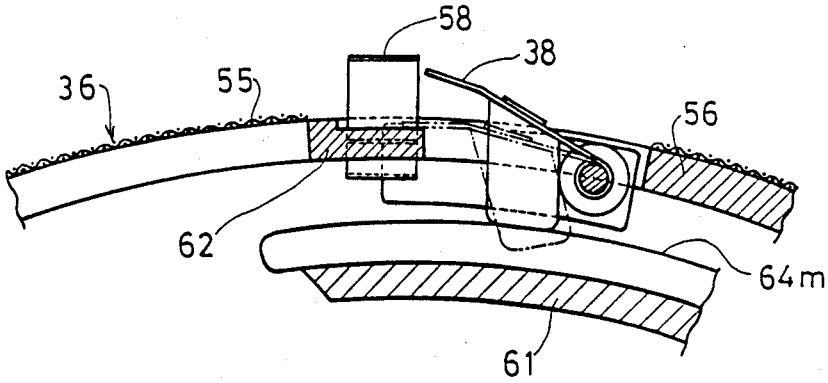
FIG. 4 is a cross-sectional view of a chucking claw provided on the transfer drum.
Figure 5:
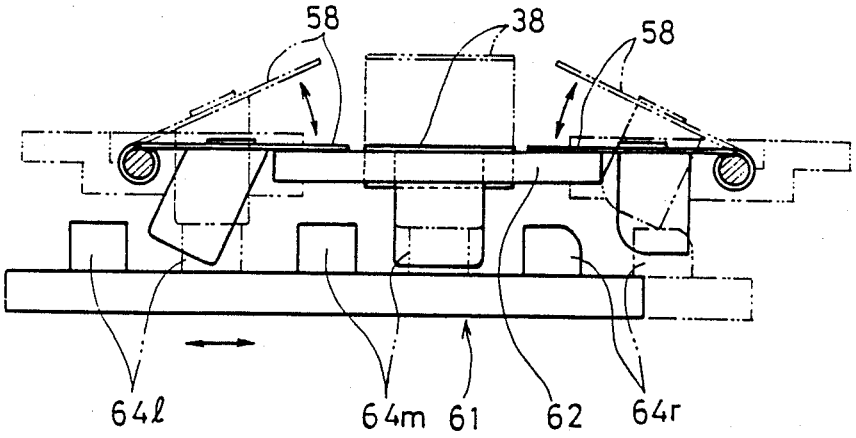
FIG. 5 is a longitudinal sectional view of the chucking claw in FIG. 4.

The chucking claw 38 and the push-up claws 58, 58 make an opening operation when they run onto a second guide rail 61 disposed inside the transfer drum 36 at a sheet separation section Q. By this opening operation of the chucking claw 38, the leading edge of the transfer sheet is released from the chucked state, and then it is positively separated from the surface of the transfer drum 36 by the push-up operation of the push-up claws 58, 58. FIGS. 4 and 5 illustrate the abovementioned state in detail, and the chucking claw 38 and push-up claws 58, 58 are so constructed as to be urged in the direction of making a closing operation by torsion springs (not shown) respectively so that their head portions come in contact with a stopper plate 62.

A second guide rail 61 is so constructed as to be shifted in the direction vertical to the plane of FIGS. 3 and 4 and a solenoid 63 is provided therefor (see FIG. 3). Further, the second guide rail 61 is provided on its upper surface with cam springs 641, 64*m*, 64*r* in correspondence with the first push-up claw 58, the chucking claw 38 and the second push-up claw 58. When the second guide rail 61 is shifted to the position shown with a phantom line in FIG. 5, firstly the chucking claw 38 and then the push-up claws 58, 58 are pushed up by these cam springs 641, 64*m*, 64*n* to make the opening operation. At an ordinary time, the second guide rail 61 is waiting in the position shown with a solid line in FIG. 5. At this time, the chucking claw 38 and the push-up claws 58, 58 are kept in the closed state. Only when a transfer sheet need to be separated from the surface of the transfer drum 36, the second guide rail 61 is shifted to the position shown with the phantom line in FIG. 5 to open the chucking claw 38 and the push-up claws 58, 58 as abovementioned.

Similarly, the first guide rail 59 is shifted in the direction vertical to the plane of the FIG. 3 by an action of a solenoid 65 shown in the figure, and opens and closes the chucking claw 38 only for chucking the leading end of the transfer sheet. The first guide rail 59 is provided with only one cam spring 66 which corresponds to the middle cam spring 64*m* of the second guide rail 61.

As shown in FIG. 1, a frame 22 supporting the transfer drum 36 is supported by the apparatus so as to make a pivotal movement about an axis 41 and is urged counterclockwise by a spring 40. Thereby the transfer drum 36 is in pressing contact with a positioning roller 39 provided on the side of the photosensitive drum 1 so as to keep a constant space between the photosensitive drum 1 and the transfer drum 36. This space is selected within the range from 0.05 to 0.70 mm.

On the side of the inner circumferential surface of the transfer drum 36, an adsorption charger 24, a transfer charger 25 and a first de-electrification charger 26 are provided as shown in FIGS. 1 and 3. On the outer circumferential surface of the transfer drum 36, an earth electrode 23 and, a second de-electrification charger 27 are provided opposite to the adsorption charger 24 and the first de-electrification charger 26 respectively, and further a separation claw 28 is provided at the sheet separation section Q.

The adsorption charger 24 performs corona discharge of negative charges to negatively electrify the dielectric screen 55 of the transfer drum 36 so that a transfer sheet delivered with its leading edge being chucked onto the transfer drum 36 by the chucking claw 38 is electrostatically adsorbed onto the dielectric screen 55. At this time, the earth electrode 23 is put into contact with the transfer sheet by function of a selenoid 67 shown in FIG. 3, thereby eliminating any influence of the adsorption charger 24 upon the transfer sheet and ensure the electrostatic adsorption of the transfer sheet onto the transfer drum 36. By making use of the adsorption charger 24, the potential of the dielectric screen 55 is measured, but this will be described later.

The transfer charger 25 is disposed at a transfer section S where the photosensitive drum 1 and the transfer drum 36 are most adjacent to each other, and by discharging positive charges through corona discharge, it electrostatically transfers a toner image formed on the photosensitive drum to the transfer sheet on the transfer drum 36. Both of the first de-electrification charger 26 and the second de-electrification charger 27 de-electrify by AC output and constitute in a pair a de-electrification charging device 68. The first de-electrification charger 26 mainly de-electrifies the dielectric screen 55 to decrease the power of electrastatically adsorbing the transfer sheet, while the second de-electrification charger 27 mainly de-electrifies the surface of the transfer sheet at the time of being separated from the transfer drum 36 to prevent occurrence of discharge at the separation time and thereby preventing the dispersion of the toner image.

The transfer sheet separated from the transfer drum 36 by means of the separation claw 28 is transported by a conveyor 29 to a fixing device 30, and there, the transferred image is fixed by heat on the transfer sheet. Then the transfer sheet is discharged onto a paper discharge tray 32.

In FIGS. 1 and 3, numeral 46 indicates a potential sensor (potential measuring means) for measuring the potential of the dielectric scren 55, numeral 44, numeral 44 indicating a positon detecting sensor for detecting the basic position of the rotation of the transfer drum 36 and numeral 45 indicating a support roller for supporting the rotation of the transfer drum 36.

Figure 7:
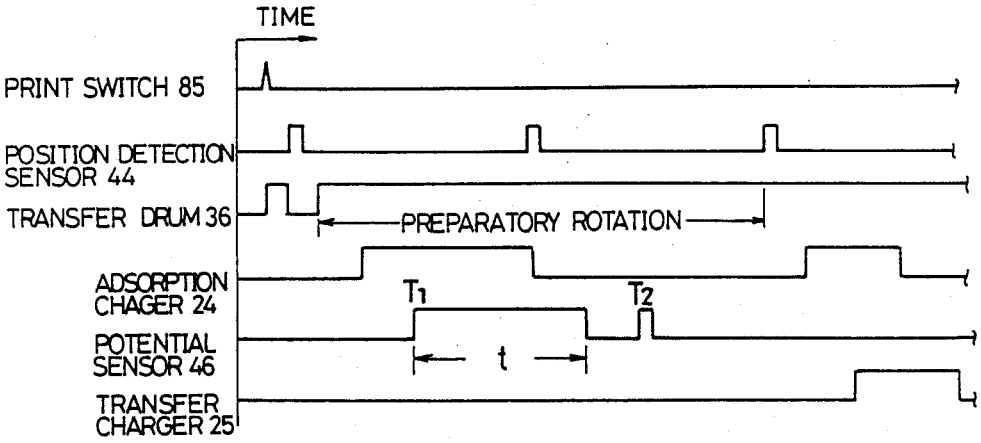
FIG. 7 is a time chart showing the timing of measuring the potential of a dielecttric screen of the transfer drum.

FIG. 3 is a block diagram of a control circuit for a suspended state judging means A for judging the suspended state of a transfer device, a preparatory rotation control means B for preparatorily rotating the transfer drum 36 when the transfer device is judged to be in the suspended state, and making the adsorption charger 24 to generate charges and operating the potential sensor 46 during the preparatory rotation of the transfer drum 36, an electrification capacity judging means C for judging the electrification capacity ability of the dielectric screen 55 according to potential measurement data obtained by the potential sensor 46 and the like. And FIG. 7 is a timing chart showing the timing of measuring the potential of the dielectric screen 55 of the transfer drum 36.

Figure 6:
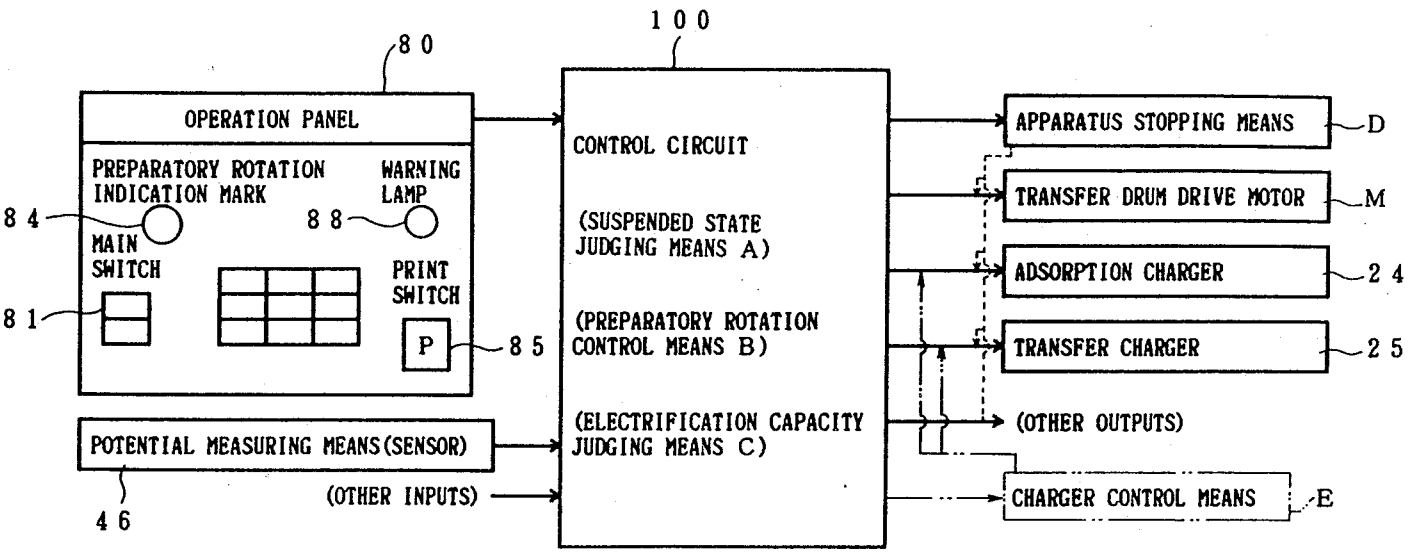
FIG. 6 is a block diagram of a control circuit of the copying apparatus of FIG. 1.

Into a control circuit 100 of the copying apparatus including the suspended state judging means A, the preparatory rotation control means B and the electrification capacity judging means C, potential measurment data from the potential sensor 46, and signals from a main switch 81 and a print switch 85 of an operation panel 80 and the like are inputted, as shown in FIG. 6.

On the other hand, from the control circuit 100, control signals are outputted to a drive circuit of an apparatus stopping means D, the operation panel 80, the potential sensor 46, a drive motor M of the transfer drum 36, the adsorption charger 24, and the transfer charger 25 respectively. Further, the control circuit 100 receives various kinds of signals, and at the same time, outputs control signals to an image reader unit 14, a laser optical system 11, the photosensitive drum 1, the developer containers 6, 7, 8, 9 and the like.

The suspended state judging means A judges that the transfer device is in a predetermined suspended state when the main switch 81 is turned on and then the print switch 85 is turned on, that is, when the main switch 81 is turned on and thereafter a first copying operation starts. Further, the suspended state judging means A also judges the transfer device to be in the predetermined suspended state if it is not the time when a first copying operation starts after turning on the main switch 81 but when a predetermined time has passed after the preceding copying operation ended.

FIG. 7 shows a timing chart of a time when the suspended state judging means A judges the transfer device to be in the predetermined suspended state. In other words, in this case, when the print switch 85 is turned on under the control of the preparatory rotation control means B, the transfer drum 36 is rotated twice as the preparatory rotation, and at the same time the output of the adsorption charger 24 and the potential measurement by the potential sensor 46 are carried out at the timings shown in FIG. 7. During this preparatory rotation, a preparatory rotation indicating lamp 84 in the operatin panel 80 is lit to indicate "UNDER PREPARATORY ROTATION". During the preparatory rotation of the transfer drum 36, the operations of the transfer charger 25, the de-electtrification charger 68, the image reader unit 14, the laser optical system 11, the photosensitive drum 1, the developer containers 6, 7, 8, 9 and the like are stopped. Further, the pair of resister rollers 20 are stopped and the paper feed to the transfer drum 36 is also stopped.

The adsorption charger 24 generates charges to electrify an effective circumferential surface of the dielectric screen 55 according to a signal from the control circuit 100 only at the first rotation of the preparatory rotation of the transfer drum 36 and stop the output at the second rotation. On the other hand, the potential sensor 46 measures the potential of the whole effective circumferential surface of the dielectric screen 55 electrified by the adsorption charger 24 at the first rotation of the transfer drum 36 (the measuring time being indicated by t in FIG. 7), and also measures the potential of a predetermined portion of the dielectric screen 55 at time $T_2$ after the output of the adsorption charger 24 is stopped at the second rotation. Since the potential of this predetermined portion has been measured at time $T_1$ at the first rotation as shown in FIG. 7, it is measured two times in total.

Figure 8:
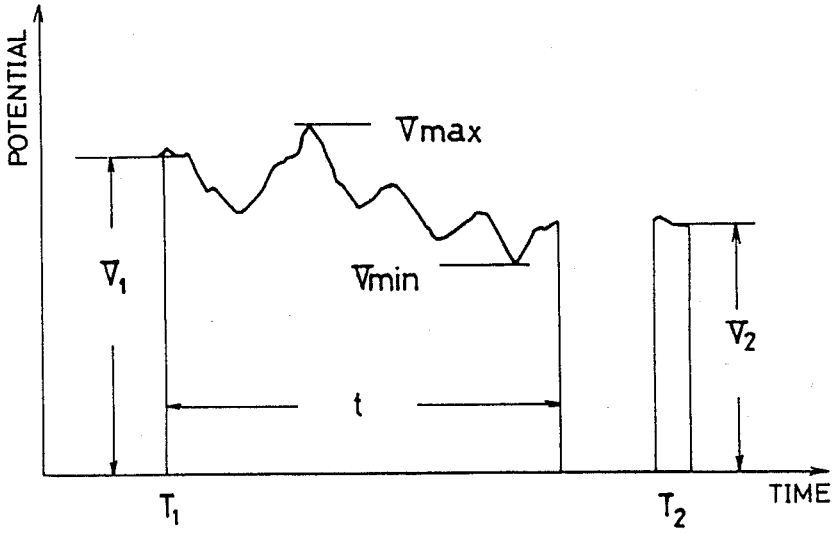
FIG. 8 is a graph showing an example of measurement of the potential of the dielectric screen of the transfer drum.

FIG. 8 shows an example of a result of the measurement by the potential sensor 46. By the abovementioned measurement, data of the maximum potential $V_{max}$ and the minimum potential $V_{min}$ can be obtained. Besides, data of the potential $V_1$ of the predetermined portion measured immediately after the electrification by the adsorption charger 24, and the lowered potential $V_2$ measured after one rotation of the transfer drum can be obtained.

These data are inputted to the control circuit 100 and arithmetically processed by the electrification capacity judging means C, and compared with a judging data stored in the control circuit 100 to judge the electrification capacity of the dielectric screen 55. For example, the following judgements can be performed.

1. Attenuation of electrification $$(V_1 - V_2 \neq) > \textit{a predetermined value}$$

When the difference between the potential $V_1$ of the predetermined portion of the dielectric screen measured immediately after the electrification and the potential $V_2$ thereof measured after one rotation of the transfer drum is large, it is judged that the dielectric screen 55 is no longer usuable.

2. Uniformity of electrification $$(V_{max}-V_{min})> \text{a predetermined value}$$

When the scatter of the potentials of the effective circumferential surface of the electrified dielectric screen 55 is larger than a predetermined value, it is judged that the surface of the dielectric screen has been unevenly deformed and the dielectric screen 55 is no longer usuable.

3. Absolute value of the potential measured immediately after the electrification Whether the value $V_1$ is within a predetermined range or not. When it is not within the range, it is judged that the dielectric screen 55 is no longer usable.

4. Absolute value of the attenuated potential

Whether the value $V_2$ is within a predetermined range or not. When it is not within range, it is judged that the dielectric screen 55 is no longer usable.

5. Maximum potential $$V_{max}> \text{allowable maximum potential}$$

When the value $V_{max}$ is larger than the allowable maximum potential, the dielectric screen is assumed to have extraordinarily soiled or raised portions and is judged to be no longer usable.

6. Minimum potential $$V_{min}< \text{allowable potential}$$

When the value $V_{min}$ is smaller than the allowable minimum potential, the dielectric screen is assumed to have charger products attached thereto or recessed portions and is judged to be no longer usable.

When the electification capacity of the dielectric screen 55 is examined with respect to all or a part of the abovementioned items and judged to be lowered, an instruction of stopping the device is outputted from the control circuit 100 to the apparatus stopping means D. According to this instruction, the operations of the transfer drum 36, the photosensitive drum 1 and the like are stopped and chargers such as the adsorption charger 24 and the transfer charger 25 stop the output of charges, thereby to forbid the copying operation. At the same time, an instruction of flickering a warning lamp (a warning means) 88 is given to the warning lamp 88 in the operation panel 80. By the flicking of the warning lamp 88, it is informed that the dielectric screen 55 must be renewed. As the warning means 88, a means using a voice or other sound systems can be also used instead of a visual means.

In the abovementioned embodiment, the warning means 88 and the apparatus stopping means D are simultaneously operated when the electrification capacity of the dielectric system 55 is judged to be in a predetermined state, but the apparatus can be so arranged that either one of them is operated.

Further, in the abovementioned embodiment, the potential of the inner surface of the dielectric screen 55 is measured. However, by providing potential measuring means 46 outside the dielectric screen 55, the potential of the outer surface of the dielectric screen can be measured. Further in the abovementioned embodiment, every time the transfer device is judged to be in the suspended state, the transfer drum 36 is preparatorily rotated and the potential of the dielectric screen 55 is measured. However, in order to decrease the time required for the preparatory rotation of the transfer drum 36, it is preferable to make the abovementioned judgement after a predetermined number of copies are obtained, and then to carry out the preparatory rotation and the potential measurement and the like. Otherwise, the potential can be measured during, not the preparatory rotation, but the ordinary rotation of the transfer drum 36. In this case, it is preferable to dispose the potential measuring means 46 directly behind the adsorption charger 24, that is, just downstream of the adsorption charger 24 in the direction of the rotation of the transfer drum 36.

Furthermore, the transfer operation can be advantageously carried out in accordance with the extent of deterioration of the dielectric screen 55 and atmospheric conditions such as moisture by making use of the function of the potential measuring means 46, the adsorption charger 24, the electrification capacity judging means C and the like and by controlling outputs of the adsorption charger 24 and the transfer charger 25 according to an information issued from the judging means C.

In this embodiment, by the agency of a charger control means E shown with a phantom line in FIG. 6, the output of the adsorption charger 24 is controlled according to the information given by the electrification capacity judging means C to perform appropriate electrostatic adsorption, and at the same time the output of the transfer charger 25 is controlled thereby to perform appropriate electrostatic transfer. For performing such controls, the data $V_1$, $V_2$, $V_{max}$, $V_{min}$ shown in FIG. 8 and the like may be used. In this respect, only the output of the adsorption charger 24 has to be controlled in order to obtain an improved electrostatic adsorptivity, and only the output of the transfer charger 25 has to be controlled in order to obtain an improved electrostatic transferability.

Further, in this embodiment, the present invention is applied to a copying apparatus. However, it can be similaryly applied to other types of image forming apparatus such as a laser bean printer in which an image according to an image information other than an original is exposed on a photosensitive member. The present invention can be variously embodied within the range of the objects and claims thereof.

What is claimed is:

1. An image forming apparatus comprising;

a photoconductive member, an image exposure means for exposing an image of an original or image data corresponding to an image of an original onto the photoconductive member to form an electrostatic latent image for the required number of times, a developing means for developing the electrostatic latent image on the photoconductive member by applying toner thereto, a transfer medium supporting member for supporting a transfer medium by electrostaticly adsorbing the transfer medium onto a dielectric screen wherein the transfer medium is subjected to repeated image transfer operation for the required number of times to transfer the toner image on the photoconductive member thereto, a transfer medium feed means for feeding the transfer mediums to the transfer medium supporting member, an adsorption charger for electrifying the dielectric screen of the transfer medium supporting member to electrostaticly adsorb the transfer medium thereto, a de-electrification charger for de-electrifying the dielectric screen of the transfer medium supporting member to separate the transfer medium thereform, a potential measuring means for measuring the potential of the dielectric screen of the transfer medium supporting member, a first judging means for judging the electrification capacity of the dielectric screen according to a data of the potential of the dielectric screen measured by the potential measuring means when the dielectric screen is electrified only by the adsorption charger, and a warning means for giving a warning that the electrification capacity of the dielectric screen is in a predetermined state when the first judging means has made that judgement.

2. An image forming apparatus as defined in claim 1, wherein the warning means gives a warning visually.

3. An image forming apparatus as defined in claim 1, wherein the warning means gives a warning by a voice or another sound systems.

4. An image forming apparatus as defined in claim 1, further comprising;

a first drive means for rotatively driving the transfer medium supporting member, a second judging means for judging whether the apparatus is in a predetermined suspended state or not, and a first control means for operating the first drive means, the adsorption charger, and the potential measuring means according to a singal emitted when the second judging means judges that the transfer device is in a predetermined suspended state.

5. An image forming apparatus as defined in claim 4, wherein the second judging means judges whether the apparatus is in a predetermined suspended state or not after images are formed on a predetermined number of transfer mediums.

6. An image forming apparatus as defined in claim 1, further comprising a drive means for rotatively driving the transfer medium supporting means wherein the potential measuring means is provided just downstream of the adsorption charger in the direction of the rotation of the transfer medium supporting member and is operated during the ordinary image forming operation.

7. An image forming apparatus comprising;

a photoconductive member, a second drive means for rotatively driving the photoconductive member, an image exposure means for exposing an image of an original or image data corresponding to an image of an original onto the photoconductive member to form an electrostatic latent image for the required number of times, a developing means for developing the electrostatic latent image on the photoconductive member by applying toner thereto, a transfer medium supporting member for supporting a transfer medium by electrostaticly adsorbing the transfer medium onto a dielectric screen wherein the transfer medium is subjected to repeated image transfer operation for the required number of times to transfer the toner image on the photoconductive drum thereto, a transfer medium feed means for feeding transfer mediums to the transfer medium supporting member, an adsorption charger for electrifying the dielectric screen of the transfer medium supporting member to electrostaticly adsorb the transfer medium thereto, a first drive means for rotatively driving the transfer medium supporting member, a transfer charger for electrostaticly transferring toner image on the photoconductive member onto the transfer medium on the transfer medium supporting member, a de-electrification charger for de-electrifying the dielectric screen of the transfer medium supporting member to separate the transfer medium therefrom, a potential measuring means for measuring the potential of the dielectric screen of the transfer medium supporting member, a first judging means for judging the electrification capacity of the dielectric screen according to a data of the potential of the dielectric screen measured by the potential measuring means when the dielectric screen is electrified only by the adsorption charger, and a control means for stopping the operations of the first and the second drive means, the adsorption charger, a transfer charger, and other means relating to the image forming operation when the first judging means judges that the electrification capacity of the dielectric screen is in a predetermined state.

8. An image forming apparatus as defined in claim 7, further comprising;

a second judging means for judging whether or not the apparatus is in a predetermined suspended state, and a further control means for operating the first drive means, the adsorption charger, and the potential measuring means according to a signal emitted when the second judging means judges that the apparatus is in a predetermined suspended state.

9. An image forming apparatus as defined in claim 8, wherein the second judging means judges whether the apparatus is in a predetermined suspended state or not after images are formed on a predetermined number of transfer mediums.

10. An image forming apparatus as defined in claim 7, wherein the potential measuring means is provided just downstream of the adsorption charger in the direction of the rotation of the transfer medium supporting member and is operated during the ordinary image forming operation.

11. An image forming apparatus comprising;

a photoconductive member, a second drive means for rotatively driving the photoconductive member, an image exposure means exposing an image of an original or image data corresponding to an image of an original onto the photoconductive member to form an electrostatic latent image for the required number of times, a developing means for developing the electrostatic latent image on the photoconductive member by applying toner thereto, a transfer medium supporting member for supporting a transfer medium by electrostaticly adsorbing the transfer medium onto a dielectric screen wherein the transfer medium is subjected to repeated image transfer operation for the required number of times to transfer the toner image on the photoconductive drum thereto, a transfer medium feed means for feeding transfer medium to the transfer medium supporting member, an adsorption charger for electrifying the dielectric screen of the transfer medium supporting member to electrostaticly adsorb the transfer medium thereto, a first drive means for rotatively driving the transfer medium supporting member, a transfer charger for electrostaticly transferring a toner image on the photoconductive member to the transfer medium on the transfer medium supporting member, a de-electrification charger for de-electrifying the dielectric screen of the transfer medium supporting member to separate the transfer medium therefrom, a potential measuring means for measuring the potential of the dielectric screen of the transfer medium supporting member, a first judging means for judging the electrification capacity of the dielectric screen according to a data of the potential of the dielectric screen measured by the potential measuring means when the dielectric screen is electrified only by the absorption charger, a warning means for giving a warning that the electrification capacity of the dielectric screen is in a predetermined state when the first judging means has made that judgement, and an off control means for stopping the operations of the first and the second drive means, the adsorption charger, a transfer charger, and other means relating to the image forming operation when the first judging means judges that the electrification capacity of the dielectric screen is in a predetermined state.

12. An image forming apparatus as defined in claim 11, wherein the warning means gives a warning visually.

13. An image forming apparatus as defined in claim 11, wherein the warning means gives a warning by a voice or other sound systems.

14. An image forming apparatus as defined in claim 11, further comprising;

a second judging means for judging whether the apparatus is in a predetermined suspended state or not, and an on control means for operating the first drive means, the adsorption charger, and the potential measuring means according to a signal emitted when the second judging means judges that the apparatus is in a predetermined suspended state.

15. An image forming apparatus as defined in claim 14, wherein the second judging means judges whether the apparatus is in a predetermined suspended state or not after images are formed on a predetermined number of transfer mediums.

16. An image forming apparatus as defined in claim 11, wherein the potential measuring means is provided just downstream of the adsorption charger in the direction of the rotation of the transfer medium supporting member and is operation during the ordinary image forming operation.

17. An image forming apparatus comprising;

a photoconductive member, an image exposure means for exposing an image of an original or image data corresponding to an image of an original onto the photoconductive member to form an electrostatic latent image for the required number of times, a developing means for developing the electrostatic latent image on the photoconductive member by applying toner thereto, a transfer medium supporting member for supporting a transfer medium by electrostaticly adsorbing the transfer medium onto a dielectric screen wherein the transfer medium is subjected to repeated image transfer operation by a transfer charger for the required number of times to transfer the toner image on the photoconductive member thereto, a transfer medium feed means for feeding the transfer mediums to the transfer medium supporting member, an adsorption charger for electrifying the dielectric screen of the transfer medium supporting mmember to electrostaticly adsorb the transfer medium thereto.

a de-electrification charger for de-electrifying the dielectric screen of the transfer medium supporting member to separate the transfer medium therefrom, a potential measuring means for measuring the potential of the dielectric screen of the transfer medium supporting member, a first judging means for judging the electrification capacity of the dielectric screen according to a data of the potential of the dielectric screen measured by the potential measuring means when the dielectric screen is electrified only by the absorption charger, and an output control means for controlling the output or outputs of both or one of the adsorption charger and the transfer charger according to the information given by the first judging means.

18. An image forming apparatus as defined in claim 17, further comprising;

a warning means for giving a warning that the electrification capacity of the dielectric screen is in a predetermined state when the first judging means has made that judgement.

19. An image forming apparatus as defined in claim 18, wherein the warning means gives a warning visually.

20. An image forming apparatus as defined in claim 18, wherein the warning means gives a warning by a voice or other sound systems.

21. An image forming apparatus as defined in claim 17, further comprising;

a first drive means for rotatively driving the transfer medium supporting member, a second judging means for judging whether the apparatus is in a predetermined suspended state or not, and a first control means for operating the first drive means, the adsorption charger, and the potential measuring means according to a signal emitted when the second judging means judges that the apparatus is in a predetermined suspended state.

22. An image forming apparatus as defined in claim 21, wherein the second judging means judges whether the apparatus is in a predetermined suspended state or not after images are formed on a predetermined number of transfer mediums.

23. An image forming apparatus as defined in claim 17, further comprising a drive means for rotatively driving the transfer medium supporting means wherein the potential measuring means is provided just downstream of the adsorption charger in the direction of the rotation of the transfer medium supporting member and is operated during the ordinary image forming operation.

* * * * *